US005433871A

United States Patent [19]

O'Connor et al.

[11] Patent Number: 5,433,871

[45] Date of Patent: Jul. 18, 1995

[54] PROCESS FOR THE PRODUCTION OF A LUBRICATING OIL ADDITIVE CONCENTRATE

[75] Inventors: Sean P. O'Connor, Hull; John Crawford, Caterham; Charles Cane, Hull, all of England

[73] Assignee: BP Chemicals (Additives) Limited, London, England

[21] Appl. No.: 157,336

[22] Filed: Nov. 23, 1993

Related U.S. Application Data

[63] Continuation of Ser. No. 686,872, Apr. 16, 1991, abandoned, which is a continuation of Ser. No. 363,537, Jun. 8, 1989, abandoned.

[30] Foreign Application Priority Data

Jun. 14, 1988 [GB] United Kingdom ..... 8814009

[51] Int. Cl.[6] ..... C10M 159/20; C10M 159/22; C10M 159/24

[52] U.S. Cl. ..... 252/18; 252/33.2; 252/39

[58] Field of Search ..... 252/18, 33.2, 39

[56] References Cited

U.S. PATENT DOCUMENTS

| | | | |
|---|---|---|---|
| 3,256,186 | 6/1966 | Greenwald | 252/33 |
| 3,535,242 | 10/1970 | Hashimoto et al. | 252/33 |
| 3,539,511 | 11/1970 | Sabol et al. | 252/33 |
| 3,544,463 | 12/1970 | Kroft, Jr. | 252/33 |
| 3,658,703 | 4/1972 | Gragson et al. | 252/33 |
| 3,671,430 | 6/1972 | Corringer | 252/33 |
| 3,766,066 | 10/1973 | McMillen | 252/33 |
| 4,328,111 | 5/1982 | Watson et al. | 252/33.4 |
| 4,617,135 | 10/1986 | Muir . | |
| 4,698,170 | 10/1987 | Le Coent | 252/33 |
| 4,879,053 | 11/1989 | Matthews et al. | 252/33 |
| 5,162,085 | 11/1992 | Cane et al. | 252/18 |
| 5,281,345 | 1/1994 | Crawford et al. | 252/33.2 |
| 5,330,665 | 7/1994 | Cane et al. | 252/39 |

FOREIGN PATENT DOCUMENTS

| | | | |
|---|---|---|---|
| 0014801 | 9/1980 | European Pat. Off. . | |
| 0095322 | 11/1983 | European Pat. Off. | C10M 159/22 |
| 1139172 | 1/1969 | United Kingdom . | |
| 1154370 | 6/1969 | United Kingdom . | |
| 1483460 | 8/1977 | United Kingdom . | |
| 1483460 | 8/1977 | United Kingdom . | |
| 2036781 | 7/1980 | United Kingdom . | |
| 2037801 | 7/1980 | United Kingdom . | |
| 8803944 | 6/1988 | WIPO . | |
| 8803945 | 6/1988 | WIPO . | |

*Primary Examiner*—Jerry D. Johnson

*Attorney, Agent, or Firm*—Brooks Haidt Haffner & Delahunty

[57] ABSTRACT

A process for the production of a lubricating oil additive concentrate having a TBN greater than 300 which process comprises reacting at elevated temperature component (A) a defined mixture selected from defined sulphurized or non-sulphurized acids or calcium salts thereof, component (B) an alkaline earth metal base added either in a single addition or in a plurality of additions at intermediate points during the reaction, component (C) at least one compound which is (i) water, (ii) a polyhydric alcohol having 2 to 4 carbon atoms, (iii) a di- ($C_3$ or $C_4$) glycol, (iv) a tri-($C_2$–$C_4$) glycol, (v) a mono- or poly-alkylene glycol alkyl ether of the formula (I)

$$R(OR^1)_xOR^2 \quad (I)$$

wherein R is a $C_1$ to $C_6$ alkyl group, $R^1$ is an alkylene group, $R^2$ is hydrogen or a $C_1$ to $C_6$ alkyl group and x is an integer from 1 to 6, (vi) a $C_1$ to $C_{20}$ monohydric alcohol, (vii) a $C_1$ to $C_{20}$ ketone, (viii) a $C_1$ to $C_{10}$ carboxylic acid ester, or (ix) a $C_1$ to $C_{20}$ ether, component (D) a lubricating oil, component (E) carbon dioxide added subsequent to the, or each, addition of component (B), component (F) a defined carboxylic acid or derivative, component (G) at least one compound which is (i) an inorganic halide or (ii) an ammonium alkanoate or a mono-, di-, tri- or tetra-alkyl ammonium formate or alkanoate provided that when component (G) is (ii), component (F) is not an acid chloride, the weight ratios of all components being such as to produce a concentrate having a TBN greater than 300.

5 Claims, No Drawings

PROCESS FOR THE PRODUCTION OF A LUBRICATING OIL ADDITIVE CONCENTRATE

This application is a continuation of application Ser. No. 07/686,872, filed Apr. 16, 1991 now abandoned, which is a continuation of Ser. No. 07/363,537, filed Jun. 8, 1989, now abandoned.

The present invention relates to a process for the production of and compositions comprising a lubricating oil additive concentrate containing mixtures of alkaline earth metal hydrocarbyl-substituted salts of acids selected from phenol (carbolic acid), sulphonic acid, naphthenic acid and salicylic acid, i.e. phenates, sulphonates, napthenates and salicylates and/or their sulphurised derivatives.

In the internal combustion engine, by-products from the combustion chamber often blow by the piston and admix with the lubricating oil. Many of these by-products form acidic materials within the lubricating oil.

Compounds generally employed to neutralise the acidic materials and disperse sludge within the lubricating oil are the metal hydrocarbyl-substituted phenates, salicylates and sulphonates and sulphurised derivatives thereof, wherein the metal is an alkaline earth metal such as calcium, magnesium, barium or strontium. Both "normal" and "overbased" alkaline earth metal hydrocarbyl-substituted salts, have been employed. The term "overbased" is used to describe those alkaline earth metal hydrocarbyl-substituted salts in which the ratio of the number of equivalents of the alkaline earth metal moiety to the number of equivalents of the acid moiety is greater than one, and is usually greater than 1.2 and may be as high as 4.5 or greater. In contrast, the equivalent ratio of alkaline earth metal moiety to phenol moiety in "normal" alkaline earth metal hydrocarbyl-substituted salts is one.

Thus, the "overbased" material usually contains greater than 20% in excess of the alkaline earth metal present in the corresponding "normal" material. For this reason "overbased" alkaline earth metal hydrocarbyl-substituted salts have a greater capability for neutralising acidic matter than do the corresponding "normal" alkaline earth metal hydrocarbyl-substituted salts.

Individual alkaline earth metal hydrocarbyl-substituted salts, for example sulphonates, having a total base number (TBN) expressed in mgKOH/g above 400 are known. Furthermore, it is reported in GB-A-214292B that phenate/sulphonate mixtures having a TBN in the range from 300 to 450 were produced. Our efforts to reproduce the Examples in this specification have not been successful.

We have now found that the TBN of lubricating oil additive concentrates comprising mixtures of alkaline earth metal hydrocarbyl-substituted salts of acids selected from phenol, sulphonic acid, naphthenic acid and salicylic acid, i.e. mixtures of phenates, sulphonates, naphthenates and salicylates, and/or their sulphurised derivatives, can be increased whilst retaining an acceptable viscosity, that is a viscosity at 100° C. of less than 1000 cSt, and even less than 500 cSt and avoiding insolubility in oil by reacting the mixtures with further alkaline earth metal base and carbon dioxide in the presence of a defined amount of certain carboxylic acids or derivatives thereof. Moreover, instead of using pre-formed alkaline earth metal hydrocarbyl-substituted salts, the precursors thereof may be used.

Accordingly the present invention provides a process for the production of a lubricating oil additive concentrate having a TBN greater than 300 which process comprises reacting at elevated temperature component (A) which comprises at least two of A(i), A(ii), A(iii) and A(iv) wherein A(i) comprises a sulphurised or non-sulphurised hydrocarbyl-substituted phenol or calcium salt thereof, A(ii) comprises a sulphurised or non-sulphurised hydrocarbyl-substituted salicylic acid or calcium salt thereof, A(iii) comprises a sulphurised or non-sulphurised hydrocarbyl-substituted naphthenic acid or calcium salt thereof, and A(iv) comprises a hydrocarbyl-substituted sulphonic acid or calcium salt thereof, component (B) an alkaline earth metal base added either in a single addition or in a plurality of additions at intermediate points during the reaction, component (C) at least one compound which is (i) water, (ii) a polyhydric alcohol having 2 to 4 carbon atoms, (iii) a di-($C_3$ or $C_4$) glycol, (iv) a tri ($C_2$–$C_4$) glycol, (v) a mono- or poly-alkylene glycol alkyl ether of the formula (I)

$$R(OR^1)_xOR^2 \qquad (I)$$

wherein R is a $C_1$ to $C_6$ alkyl group, $R^1$ is an alkylene group, $R^2$ is hydrogen or a $C_1$ to $C_6$ alkyl group and x is an integer from 1 to 6, (vi) a $C_1$ to $C_{20}$ monohydric alcohol, (vii) a $C_1$ to $C_{20}$ ketone, (viii) a $C_1$ to $C_{10}$ carboxylic acid ester, or (ix) a $C_1$ to $C_{20}$ ether, component (D) a lubricating oil, component (E) carbon dioxide added subsequent to the, or each, addition of component (B), component (F) sufficient to provide from 2 to 40% by weight, based on the weight of the concentrate, of a carboxylic acid or an acid anhydride, acid chloride or ester thereof, said acid having the formula (II) and having a molecular weight of less than 500

$$R^3-\underset{\underset{R^4}{|}}{CH}-COOH \qquad (II)$$

wherein $R^3$ is a $C_{10}$ to $C_{24}$ alkyl or alkenyl group and $R^4$ is hydrogen, a $C_1$ to $C_4$ alkyl group or a $CH_2COOH$ group, and component (G) at least one compound which is (i) an inorganic halide or (ii) an ammonium alkanoate or a mono-, di-, tri- or tetra-alkyl ammonium formate or alkanoate provided that when component (G) is (ii), component (F) is not an acid chloride, the weight ratios of all components being such as to produce a concentrate having a TBN greater than 300.

Component (A) of the reaction mixture is at least two of A(i), A(ii), A(iii) and A(iv) wherein A(i) comprises a sulphurised or non-sulphurised hydrocarbyl-substituted phenol or calcium salt thereof, A(ii) comprises a sulphurised or non-sulphurised hydrocarbyl-substituted salicylic acid or calcium salt thereof A(iii) comprises a sulphurised or non-sulphurised hydrocarbyl-substituted naphthenic acid or calcium salt thereof and A(iv) comprises a hydrocarbyl-substituted sulphonic acid or calcium salt thereof.

Each of the categories A(i), A(ii), A(iii) and A(iv) may comprise one compound as defined or a mixture of compounds as defined.

Where component (A) comprises a non-sulphurised acid or a non-sulphurised calcium salt, there may be added a source of sulphur, for example elemental sulphur, a sulphur monohalide or a sulphur dihalide.

Although it is possible to use as component (A) a mixture of two or more acids as defined herein, it is preferred that component (A) comprise at least one calcium salt as defined herein i.e. upgrade a pre-formed calcium salt. Both neutral and overbased salts may be up-graded in this matter. Calcium salts of either sulphurised or non-sulphurised hydrocarbyl-substituted acids may be used.

The hydrocarbyl substituent of the hydrocarbyl-substituted salts and the hydrocarbyl-substituted acids and their sulphurised derivatives may contain up to 125 aliphatic carbon atoms. Examples of suitable substituents include alkyl radicals, for example hexyl, cyclohexyl, octyl, isooctyl, decyl, tridecyl, hexadecyl, eicosyl and tricosyl, radicals derived from the polymerisation of both terminal and internal olefins, for example ethene, propene, 1-butene, isobutene, 1-hexene, 1-octene, 2-butene, 2-pentene, 3-pentene and 4-octene. Preferably the hydrocarbyl substituent is one derived from a monoolefin, more preferably from a monoolefin which is either propene, 1-butene or isobutene.

The alkaline earth metal base (component B) may suitably be an alkaline earth metal oxide or hydroxide, preferably the hydroxide. Calcium may be added for example in the form of quick lime (CaO) or in the form of slaked lime ($Ca(OH)_2$). Preferred alkaline earth metals are calcium, magnesium, strontium and barium preferably calcium. The alkaline earth metal base must be added in an amount relative to component (A) sufficient to produce a product having a TBN in excess of 300, preferably in excess of 350. This amount will depend on a number of factors including whether or not component (A) contains any calcium, the nature of the hydrocarbyl-substituent and will be higher than the amounts generally employed in prior art processes. Typically, the weight ratio of component (B) to component (A) may suitably be in the range from 0.2 to 50, preferably from 0.4 to 10.

Component (B) may be added in whole to the initial reactants, or in part to the initial reactants and the remainder in one or more portions at a subsequent stage or stages in the process. It is preferred that component (B) is added in a single addition.

As component (C) there may be used one or more polar organic compounds as defined or water, or mixtures thereof; preferably a polar organic compound.

Suitable compounds having the formula (I) include the monomethyl or dimethyl ethers of (a) ethylene glycol, (b) diethylene glycol, (c) triethylene glycol or (d) tetraethylene glycol. A particularly suitable compound is methyl diglycol ($CH_3OCH_2CH_2OCH_2CH_2OH$). Mixtures of glycol ethers of formula (I) and glycols may also be employed. Using a glycol ether of formula (I) or a glycol as component (C) it is preferred to use in combination therewith an inorganic halide, for example ammonium chloride, and a lower, i.e. $C_1$ to $C_4$, carboxylic acid, for example acetic acid. The polyhydric alcohol may suitably be either a dihydric alcohol, for example ethylene glycol or propylene glycol, or a trihydric alcohol, for example glycerol. The di- ($C_3$ or $C_4$) glycol may suitably be dipropylene glycol, the tri- ($C_2$ to $C_4$) glycol may suitably be triethylene glycol. Preferably the component (C) is either ethylene glycol or methyl diglycol, the latter in combination with ammonium chloride and acetic acid.

Component (C), may also suitably be a $C_1$ to $C_{20}$ monohydric alcohol, a $C_1$ to $C_{20}$ ketone, a $C_1$ to $C_{10}$ carboxylic acid ester or a $C_1$ to $C_{20}$ ether which may be aliphatic,alicyclic or aromatic. Examples are methanol, acetone, 2-ethyl hexanol, cyclohexanol,cyclohexanone, benzyl alcohol, ethyl acetate and acetophenone, preferably 2-ethyl hexanol. In the preferred method of producing the concentrate of the present invention, there may be used in combination (i) component (C) as defined above and (ii) a solvent.

As the solvent (ii) there may suitably be used an inert hydrocarbon, which may be aliphatic or aromatic. Examples of suitable solvents (ii) include toluene, xylene, naphtha and aliphatic paraffins, for example hexane, and cycloaliphatic paraffins.

A particularly preferred combination of (i) and (ii) is methanol and toluene. An advantage of using a combination of (i) and (ii) is that the use of ethylene glycol can be avoided. Residual ethylene glycol in the lubricating oil additive may result in corrosion of an engine in which the concentrate is used.

Component (D) is a lubricating oil. The lubricating oil is suitably an animal, vegetable or mineral oil. Suitably the lubricating oil is a petroleum-derived lubricating oil, such as a naphthenic base, paraffin base or mixed base oil. Solvent neutral oils are particularly suitable. Alternatively, the lubricating oil may be a synthetic lubricating oil. Suitable synthetic lubricating oils include synthetic ester lubricating oils, which oils include diesters such as di-octyl adipate, di-octyl sebacate and tri-decyladipate, or polymeric hydrocarbon lubricating oils, for example liquid polyisobutenes and poly-alpha olefins. The lubricating oil may suitably comprise from 10 to 90%, preferably from 10 to 70%, by weight of the concentrate.

Component (E) is carbon dioxide, which may be added in the form of a gas or a solid, preferably in the form of a gas. In gaseous form it may suitably be blown through the reaction mixture. We have found that generally the amount of carbon dioxide incorporated increases with increasing concentrations of component (F).

Suitably carbon dioxide in a combined form may be present in the concentrate in an amount in the range from 5 to 20, preferably from 9 to 15% by weight based on the weight of the concentrate.

Component (F) is either (i) a carboxylic acid of formula (II), or (ii) a di- or polycarboxylic acid containing from 36 to 100 carbon atoms, or an acid anhydride, an acid chloride or ester of (i) or (ii). As regards (i), this is a carboxylic acid having the formula (II) or an acid anhydride, acid chloride or ester thereof. Preferably $R^3$ is an unbranched alkyl or alkenyl group. Preferred acids of formula (II) are those wherein $R^4$ is hydrogen and $R^3$ is a $C_{10}$ to $C_{24}$, more preferably $C_{18}$ to $C_{24}$ unbranched alkyl group. Examples of suitable saturated carboxylic acids of formula (II) include capric, lauric, myristic, palmitic, stearic, isostearic, arachidic, behenic and lignoceric acids. Examples of suitable unsaturated acids of formula (II) include lauroleic, myristoleic, palmitoleic, oleic, gadoleic, erucic, ricinoleic, linoleic and linolenic acids. Mixtures of acids may also be employed, for example rape top fatty acids. Particularly suitable mixtures of acids are those commercial grades containing a range of acids, including both saturated and unsaturated acids. Such mixtures may be obtained synthetically or may be derived from natural products, for example tall, cotton, ground nut, coconut, linseed, palm kernel, olive, corn, palm, castor, soyabean, sunflower, herring and sardine oils and tallow. Sulphurised acids and acid mixtures may also be employed. Instead of, or in addition to, the carboxylic acid there may be used the acid anhydride, the acid chloride or the ester derivatives of the acid, preferably the acid anhydride. It is preferred however to use a carboxylic acid or a mixture of carboxylic acids. A preferred carboxylic acid of formula (II) is stearic acid.

Instead of, or in addition to (i), component (F) may be (ii) a di- or polycarboxylic acid containing from 36 to 100 carbon atoms or an acid anhydride, acid chloride or ester derivative thereof, preferably an acid anhydride thereof; (ii) is preferably a polyisobutene succinic acid or a polyisobutene succinic anhydride.

Suitably the concentrate may have a viscosity measured at 100° C. of less than 1000 cSt, preferably less than 750 cSt, more preferably less than 500 cSt.

The amount of component (F) required to provide from 2 to 40% by weight based on the weight of the concentrate will be to a first approximation the amount desired in the concentrate. In calculating this amount allowance should be made for loss of water from carboxylic acids, for example.

The reaction is carried out in the presence of component (G). As component (G) there may be used (i) an inorganic halide which may suitably be either a hydrogen, an ammonium or a metal halide. Suitably the metal moiety of the metal halide may be zinc, aluminium or an alkaline earth metal, preferably calcium. Of the halides, the chloride is preferred. Suitable chlorides include hydrogen chloride, calcium chloride, ammonium chloride, aluminium chloride and zinc chloride, preferably calcium chloride.

Alternatively, component (G) may be (ii) an ammonium alkanoate or a mono-, di-, tri- or tetra-alkyl ammonium formate or alkanoate, preferably an ammonium alkanoate, more preferably ammonium acetate. Component (G) may be mixture of (i) and (ii). However, when component (G) is (ii) above, component (F) is not an acid chloride.

Suitably the amount of component (G) employed may be up to 2.0% by weight based on the weight of the concentrate.

Typically, the amount of component (F) incorporated is 10% to 35%, more preferably 12 to 20%, for example about 16% by weight based on the weight of the concentrate.

Suitably the amount of total alkaline earth metal present in the concentrate is 10 to 20% by weight based on the weight of the concentrate.

Preferably the TBN of the concentrate is greater than 350, more preferably greater than 400.

Suitably the reaction of components (A)-(G) may be carried out from 15 to 200, preferably 60° to 150° C., though the actual temperatures chosen for various stages of the reaction may differ if desired. The pressure may be atmospheric, subatmospheric or superatmospheric.

The concentrate may be recovered by conventional means, for example by distillative stripping of component (C), or the solvent (if any).

Finally, it is preferred to filter the concentrate so-obtained. Generally, the process of the invention will produce a concentrate having an acceptable viscosity, that is a viscosity of less than 1000 cSt at 100° C., and can produce concentrates having a viscosity less than 750 or 500 cSt at 100° C. Such viscometric properties are advantageous because they facilitate processing (including filtration) of the concentrate. However, it is also possible to produce concentrates having a higher viscosity than 1000 cSt at 100° C., generally at higher TBN levels. Filtration of such concentrates presents a problem, which may be overcome by adding a diluent prior to filtration and stripping the diluent off after filtration. Alternatively, high viscosity concentrates, for example concentrates having a viscosity at 100° C. greater than 1000 cSt, and also having a high TBN, for example greater than 350, may be diluted by addition of further lubricating oil whilst maintaining a TBN greater than 300, thereby facilitating filtration.

Alternatively, the concentrate can be centrifuged in the presence of a diluent.

A final aspect of the present invention provides a finished lubricating oil composition which composition comprises a lubricating oil and lubricating oil additive concentrate prepared as herein before described, Preferably the finished lubricating oil composition contains sufficient of the additive concentrate to provide a TBN of from 0.5 to 120.

The amount of additive concentrate present in the finished lubricating oil will depend on the nature of the final use. Thus, for marine lubricating oils the amount of additive concentrate present may suitably be sufficient to provide a TBN of 9 to 100 and for automobile engine lubricating oils the amount may suitably be sufficient to provide a TBN of 4 to 20.

The finished lubricating oil composition may also contain effective amounts of one or more other types of conventional lubricating oil additives, for example viscosity index improvers, anti-wear agents, antioxidants, dispersants, rust inhibitors, pour-point depressants, or the like, which may be incorporated into the finished lubricating oil composition either directly or through the intermediacy of the concentrate composition.

In addition to their use as additives for incorporation into lubricating oil compositions, the additive concentrate of the present invention may also find application as fuel additives.

The invention will now be further illustrated by reference to the following Examples. In all the Examples the term "TBN" (Total Base Number) is used. TBN is expressed in mg KOH/g as measured by the method of ASTM D2896. In the examples where lime is used, it is in the form of slaked lime $Ca(OH)_2$. Viscosities were measured by the method of ASTM D445.

EXAMPLE 1

(Phenate/Salicylate)
Charge

| | |
|---|---|
| ADX402 (Overbased calcium hydrocarbyl-substituted phenate, 250 TBN, commercially available from Adibis). | 120.8 g |
| OSCA420 (Overbased calcium hydrocarbyl-substituted salicylate, 280 TBN, commercially available from OSCA Chemicals Ltd). | 120.8 g |
| Lubricating oil | 27.3 g |
| Calcium chloride | 3.2 g |
| Stearic acid | 66.2 g |
| 2-Ethyl hexanol | 199.6 g |

Method (a) The charge was heated to 120° C. at 700 mmHg and lime (69.3 g) was added.

(b) The mixture was heated to 135° C./700 mmHg.

(c) Ethylene glycol (33.6 g) was added at 135° C./700 mmHg over a period of 5 minutes.

(d) The mixture was held at 135° C./700 mmHg for 5 minutes.

(e) Carbon dioxide (69.3 g) was added at 135° C.

(f) The product was stripped at 200° C./10 mmHg, and (g) The product was filtered.

Product Weights

| | |
|---|---|
| Crude product | 410 g |
| Distillate | 242 g |

Product Composition after Filtration

| | | |
|---|---|---|
| Calcium | 14.18% | w/w |
| Sulphur | 0.96% | w/w |
| $CO_2$ | 9.8% | w/w |
| TBN | 407 | mg KOH/g |
| $V_{100}$ | 242.6 | cSt |
| $V_{40}$ | 2221 | cSt |
| VI | 251 | |

EXAMPLE 2

(Phenate/Sulphonate)

Charge

| | |
|---|---|
| ADX 402 (see Example 1) | 230 g |
| Calcium chloride | 3 g |

Method (a) The charge was heated to 100° C.

(b) SA157 (hydrocarbyl-substituted sulphonic acid ex. Paramins, MW=480, 60% active) (57 g), stearic acid (40 g) and 2 ethyl hexanol (190 g) were added at 110° C.

(c) Lime (66 g) was added at 110° C./700 mmHg.

(d) Ethylene glycol (32 g) was added at 145° C./700 mmHg over a period of 20 minutes.

(e) The mixture was held at 145° C./700 mmHg for 5 minutes.

(f) Carbon dioxide (66 g) was added at 145° C.

(g) The product was stripped at 200° C./10 mmHg over a period of 60 minutes, and (h) The product was filtered.

Product Weights

| | |
|---|---|
| Crude product | 373.2 g |
| Distillate | 236.7 g |

Product Composition after Filtration

| | | |
|---|---|---|
| Calcium | 13.34% | w/w |
| Sulphur | 2.57% | w/w |
| Carbon dioxide | 8.4% | w/w |
| TBN | 363 | mg KOH/g |
| $V_{100}$ | 413 | cSt |
| $V_{40}$ | 12076 | cSt |
| VI | 167 | |

EXAMPLE 3

(Phenate/Sulphonate)

Charge

| | |
|---|---|
| Lubricating oil | 53 g |
| Stearic acid | 62 g |
| Calcium chloride | 4 g |
| 2-Ethyl hexanol | 90 g |

Method (a) The charge was heated to 145°-165° C./700 mmHg whilst adding ethylene glycol (32 g).

(b) The charge was held at 165° C./700 mmHg for 30 minutes.

(c) Carbon dioxide (44g) was added at 165° C.

(d) The mixture was cooled to 120° C./700 mmHg and 2-ethyl hexanol (100 g) and lime (66 g) was added.

(e) The mixture was held at 165° C./700 mmHg for 5 minutes.

(f) Carbon dioxide (66 g) was added at 165° C.

(g) The product was stripped at 200° C./10 mmHg, and (h) The product was filtered.

Product Weights

Crude product—425 g

Product Composition after Filtration

| | | |
|---|---|---|
| Calcium | 12.4% | w/w |
| Carbon dioxide | 11.7% | w/w |
| Sulphur | 1.9% | w/w |
| Ca as sulphonate | 0.17% | w/w |
| TBN | 349 | mg KOH/g |
| $V_{100}$ | 68.9 | cSt |
| $V_{40}$ | 654 | cSt |
| VI | 181 | |

EXAMPLE 4

(Sulphonate/Phenate)

Charge

| | |
|---|---|
| ADX 100 ($C_{12}$ alkyl phenol commercially available from Adibis). | 64 g |
| ADX 509 (Overbased calcium sulphonate, 400 TBN, commercially available from Surpass Ltd). | 111 g |
| Stearic acid | 59 g |
| Calcium chloride | 3 g |
| Sulphur | 23 g |
| 2-Ethyl hexanol | 190 g |
| Lubricating oil | 66 g |

Method (a) The charge was heated to 120° C./700 mmHg and lime (70 g) was added.

(b) The mixture was heated to 145°-165° C./700 mmHg whilst adding ethylene glycol (31 g).

(c) The mixture was held at 165° C./700 mmHg for 60 minutes.

(d) Carbon dioxide (67 g) was added at 165° C.

(e) The mixture was cooled to 120° C./700 mmHg and lime (30 g) was added.

(f) The mixture was held at 165° C./700 mmHg for 60 minutes.

(g) Carbon dioxide (33 g) was added at 165° C.

(h) The product was stripped at 200° C./10 mmHg, and (i) The product was filtered.

Product Weight

Crude product —438 g Product Composition after Filtration

| | |
|---|---|
| Calcium | 15.0% w/w |
| Sulphur | 2.6% w/w |
| Ca as sulphonate | less than 0.1% w/w |
| $CO_2$ | 14.7% w/w |
| TBN | 424 mg KOH/g |
| $V_{100}$ | 215 cSt |
| $V_{40}$ | 4215 cSt |
| VI | 164 |

A feature of this Example is that from 111 g overbased sulphonate there was obtained 438 g overbased detergent (300% increase).

EXAMPLE 5

(Phenate/Salicylate)

Charge

| | |
|---|---|
| ADX402 (Overbased calcium hydrocarbyl-substituted phenate, 250 TBN, commercially available from Adibis). | 120.8 g |
| OSCA 420 (Overbased calcium hydrocarbyl-substituted salicylate, 280 TBN commercially available from OSCA Chemicals Ltd). | 120.8 g |
| Lubricating oil | 27.3 g |
| Ammonium Acetate | 3.2 g |
| Stearic acid | 66.2 g |
| 2-Ethyl hexanol | 199.6 g |

Method (a) The charge was heated to 120° C. at 700 mmHg and lime (69.3 g) was added.

(b) The mixture was heated to 135° C./700 mmHg.

(c) Ethylene glycol (33.6 g) was added at 135° C./700 mmHg over a period of 5 minutes.

(d) The mixture was held at 135° C./700 mmHg for 5 minutes.

(e) Carbon dioxide (69.3 g) was added at 135° C.

(f) The product was stripped at 200° C./10 mmHg, and (g) The product was filtered.

Product Weights

Crude product—417 g

Product Composition after Filtration

| | |
|---|---|
| Calcium | 14.03% w/w |
| Sulphur | 0.99% w/w |
| TBN | 400 mg KOH/g |
| $V_{100}$ | 308.8 cSt |
| $V_{40}$ | 528.6 cSt |

We claim:

1. A process for the production of a lubricating oil additive concentrate having a TBN greater than 300 which process comprises reacting at elevated temperature component (A) which comprises at least two of A(i), A(ii), A(iii) and A(iv) wherein A(i) comprises a sulphurised or non-sulphurised hydrocarbyl-substituted phenol or calcium salt thereof, A(ii) comprises a sulphurised or non-sulphurised hydrocarbyl-substituted salicylic acid or calcium salt thereof, A(iii) comprises a sulphurised or non-sulphurised hydrocarbyl-substituted naphthenic acid or calcium salt thereof, and A(iv) comprises a hydrocarbyl-substituted sulphonic acid or calcium salt thereof, component (B) an alkaline earth metal base added either in a single addition or in a plurality of additions during the reaction, component (C) at least one compound which is (i) water, (ii) a polyhydric alcohol having 2 to 4 carbon atoms, (iii) a di- ($C_3$ or $C_4$) glycol, (iv) a tri-($C_2$–$C_4$) glycol, (v) a mono- or polyalkylene glycol alkyl ether of the formula (I)

$$R(OR^1)_xOR^2 \quad (I)$$

wherein R is a $C_1$ to $C_6$ alkyl group, $R^1$ is an alkylene group, $R^2$ is hydrogen or a $C_1$ to $C_6$ alkyl group and x is an integer from 1 to 6, (vi) a $C_1$ to $C_{20}$ monohydric alcohol, (vii) an up to $C_{20}$ ketone, (viii) an up to $C_{10}$ carboxylic acid ester, or (ix) an up to $C_{20}$ ether, component (D) a lubricating oil, component (E) carbon dioxide added subsequent to the, or each, addition of component (B), component (F) sufficient to provide from 2 to 40% by weight, based on the weight of the concentrate, of a carboxylic acid or an acid anhydride or ester thereof, said acid having the formula (II) and having a molecular weight of less than 500

$$R^3-\underset{\underset{R^4}{|}}{CH}-COOH \quad (II)$$

wherein $R^3$ is a $C_{10}$ to $C_{24}$ alkyl or alkenyl group and $R^4$ is hydrogen, a $C_1$ to $C_4$ alkyl group or a $CH_2COOH$ group, and component (G) at least one compound which is an ammonium alkanoate or a mono-, di-, tri- or tetra-alkyl ammonium formate or alkanoate provided that the weight ratios of all components being such as to produce a concentrate having a TBN greater than 300.

2. A process as claimed in claim I wherein component (A) comprises a calcium salt.

3. A process as claimed in claim 1 wherein said ammonium alkanoate is ammonium acetate.

4. A process as claimed in claim 1 wherein said lubricating oil additive concentrate has a viscosity at 100° C. of less than 1000 cSt.

5. A process as claimed in claim 1 wherein

Component (A) comprises A(i) and at least one of A(ii), A(iii) and A(iv),

Component (B) is calcium hydroxide,

Component (C) is at least one compound selected from the group consisting of ethylene glycol, methanol and 2 ethyl hexanal, Component (F) is stearic acid, and Component (G) is ammonium acetate.

* * * * *

UNITED STATES PATENT AND TRADEMARK OFFICE

CERTIFICATE OF CORRECTION

PATENT NO. : 5,433,871

DATED : July 18, 1995

INVENTOR(S) : SEAN P. O'CONNOR, JOHN CRAWFORD and CHARLES CANE

It is certified that error appears in the above-indentified patent and that said Letters Patent is hereby corrected as shown below:

Col. 8, Example 3, line 5, add in the list of ingredients of the charge before "Lubricating Oil" the following ingredient --OLOA 4300A (mixed phenate/sulphonate, 277 TBN, commercially available from Orogil Ltd) 230 g.--

Col. 9, l. 3, "Product Composition" should start a new paragraph.

Signed and Sealed this

Fifth Day of December, 1995

*Attest:*

Bruce Lehman

BRUCE LEHMAN

*Attesting Officer*

*Commissioner of Patents and Trademarks*